US006287161B1

(12) United States Patent
Nozawa

(10) Patent No.: US 6,287,161 B1
(45) Date of Patent: Sep. 11, 2001

(54) COWLING FOR OUTBOARD MOTOR

(75) Inventor: Tomohiro Nozawa, Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/344,720

(22) Filed: Jun. 25, 1999

(30) Foreign Application Priority Data

Jun. 26, 1998 (JP) ..... 10-180512
Jun. 26, 1998 (JP) ..... 10-180513

(51) Int. Cl.[7] ..... B63H 20/32
(52) U.S. Cl. ..... 440/77
(58) Field of Search ..... 440/77, 88, 900; 123/195 P

(56) References Cited

U.S. PATENT DOCUMENTS 4,379,702 * 4/1983 Takada et al. ..... 440/77
5,052,960 * 10/1991 Kato ..... 440/77
5,328,395 * 7/1994 Oishi ..... 440/77

* cited by examiner

*Primary Examiner*—Stephen Avila
(74) *Attorney, Agent, or Firm*—Ernest A. Beutler

(57) ABSTRACT

A protective cowling arrangement for the power head of an outboard motor and an air inlet arrangement therefor. The cowling arrangement is comprised of a cowling portion that defines an internal area in which the engine of the outboard motor is contained and a pair of expansion chambers formed on opposite sides of the cowling assembly and each of which is provided with a respective air delivery port at a forward end thereof for increasing the air flow area available to the interior of the cowling assembly and for placing the point of air admission away from components of the associated engine that should be protected. An improved water gutter and drain arrangement is also employed to prevent water from entering into the engine area.

19 Claims, 11 Drawing Sheets

COWLING FOR OUTBOARD MOTOR

BACKGROUND OF THE INVENTION

This invention relates to an outboard motor and more particularly to an improved protective cowling therefor.

As is well known, outboard motors generally include a power head that consists of a powering internal combustion engine and a surrounding protective cowling. The cowling is provided around the engine so as to provide a neater appearance and also to protect the engine from foreign materials. Of course, it is necessary that the protective cowling have an inlet opening arrangement so that air for combustion of the engine can enter the protective cowling in adequate quantities to maintain the desired maximum engine output. This gives rise to a number of problems.

First, it is important that the cowling inlet opening be positioned and configured in such a way that there can be adequate air flow to the engine so as to provide the desired output of the engine. However, because of the operation in close proximity to large bodies of water and since the water frequently may be sprayed upwardly by the operation of the watercraft into proximity with the inlet opening, there must be insurance against the ingestion of water through the inlet opening into the interior of the protective cowling where it could possibly damage the engine. Thus, arrangements have been provided that will assist in separating the water from the inducted air to prevent the water from entering into the interior of the protective cowling.

Although the goal is simple, the achievement of this goal is much more complicated. It is of course desirable to maintain a slim profile for the power head and also so as to avoid undue height. Thus, the space available for this air induction and water separation is quite restricted.

It has been proposed to employ various arrangements wherein a labyrinth type air flow path is provided between the atmospheric air inlet opening and the opening in the protective cowling that permits the air to enter the interior of the protective cowling. Such air flow paths, however, provide a reduced flow area and can restrict the output of the engine.

Also, there is a problem in connection with the draining of the separated water from the inducted air so that the water does not reenter the air stream and pass into the interior of the protective cowling. Generally, the air inlet openings are provided at the rear of the cowling and the drain passages for the return of the separated water from the cowling area is in proximity to the inlet opening. This provides significant problems in that the air flow may tend to sweep the separated water back into the interior of the protective cowling.

It is, therefore, a principal object of this invention to provide an improved air inlet device for the protective cowling of an outboard motor.

It is a further object of this invention to provide an air inlet arrangement or an outboard motor protective cowling that provides substantial separation between the air inlet opening for the induction system and the water drain for draining separated water from the inducted air before it passes into the interior of the protective cowling and into proximity with the engine.

In addition to the issue of avoiding restrictions in air flow, it is also desirable if the induction system provided in the cowling can provide an expansion chamber area. This will assist in not only maintaining good induction properties but also can assist in silencing the inducted air. However, if the expansion chamber volume is increased, then the exterior configuration of the protective cowling can be unduly bulky.

It is, therefore, a still further object of this invention to provide an improved intake arrangement for the protective cowling of an outboard motor that will provide sufficient expansion volume and will do this in such a way that the overall size of the cowling is not increased.

Because of the demand for larger and larger power outputs for outboard motors, the number of cylinders employed in the engine is substantially increasing. This gives rise to further expansion in the overall size of the protective cowling and also means that there is a greater engine displacement and hence more air is required for engine operation.

Furthermore, in order to improve the performance of the engine, it has been proposed to utilize such performance improving features like fuel injection systems. The fuel injection system may also be of the direct cylinder type which can provide further enhancements of engine operation. However, the use of fuel injection systems adds to the number of components that are contained within the protective cowling and this is further complicated when direct injection systems are employed.

The direct injection systems require not only a greater number of fuel injectors but also more complicated supply systems. The supply system becomes more complicated because higher pressures must be generated in direct injected engines and thus additional and high-pressure positively driven fuel pumps may become necessary.

All of these components are generally positioned in the area of the protective cowling that is contiguous to the air inlet area. This means that these delicate and sensitive components of the engine and specifically of its fuel injection system may become exposed to inducted water. Thus, the aforenoted problems with respect to water separation are even more important in connection with outboard motors having fuel injection systems and particularly direct injection systems.

Furthermore, the positioning of the inlet arrangement utilized with conventional outboard motor protective cowlings is such that the air is inducted in an area in close proximity to where many of the fuel injection system components are located. Thus, it is highly likely that any water in the inducted air will contact these components and cause potential problems.

It is, therefore, a still further principal object of this invention to provide an improved protective cowling arrangement and air inlet arrangement therefor that is particularly adapted for use with outboard motors having fuel injection and particularly direct cylinder injection.

The problems in conjunction with the prior art type of protective cowling arrangements can be best understood by reference to FIGS. 1–3. These figures show the main cowling member, indicated generally by the reference numeral 21, of the type utilized with conventional prior art type of constructions. The main cowling member 21 is comprised primarily of two main components both of which may be formed from a suitable material such as a molded fiberglass reinforced resin or the like. These two components of the main cowling member 21 are detachably connected to a tray which is not shown and which with the main cowling member 21 encircles the powering internal combustion engine, which is not illustrated in these figures.

The main cowling member 21 is comprised of a main cowling portion 22 that has a generally inverted cup-shaped configuration and which defines an internal cavity 23 in which the associated engine is contained. The main cowling member 22 has an upper surface 24 that is formed with an indented portion 25 at the rear end thereof which is covered and enclosed by a closure member 26 that is connected to the main cowling member 22 in a suitable manner, such as by means of fasteners 27. An upstanding inlet opening neck 28 that defines an internal passage 29 that communicates the chamber formed by the indented area 25 and the closure member 26 with the interior 23 of the protective cowling member 21.

The closure member 26 is provided, as best seen in FIG. 3, with a plurality of slotted openings 31 formed in the rearward portion thereof that permit air to flow into the indented area 25 as seen by the arrows A in FIGS. 1 and 2. This air then flows around the inlet neck 28 and downwardly through the opening 29 into the cowling interior 23 for induction into the engine for combustion.

By utilizing the tuning neck 28 and the somewhat circuitous air flow path, water will tend to separate from the inducted air. This water then is drained down into a drain recess 32 that is formed at the rear of an upstanding rear surface 33 of the main cowling member 22. The closure member 26 has a skirt portion 34 that partially encloses this recess 32 and defines a lower drain slot 35 through which water is intended to drain. By utilizing the recess 32 and slot 35, the water return may be separated from the air inlet openings 31 so as to attempt to minimize the amount of water that can reenter the inducted air.

It will be seen that the area adjacent the recess 27 in the main cowling member 22 and the closure 26 defines a small gap 36 which is necessary to accommodate manufacturing variations and the like. This, however, gives rise to an area where air can seep into the interior as indicated by the arrows AL in FIG. 1 and tend to bypass the separation system and flow directly into the air outlet opening 29.

It is, therefore, a further object of this invention to provide an improved cowling construction for an outboard motor wherein water is separated from air that may leak through gaps in the cowling and drained away from the air inlet.

Also, the air outlet opening 29 is disposed immediately above the engine and with certain type engines, as will become apparent when the preferred embodiment of the invention is described, this is in proximity to many components of the fuel injection system that should be protected from water.

One way that this protection can be improved is by raising the height of the cowling in this area as shown in phantom in FIG. 2. This, however, provides not only an obstruction to visibility but provides a less than pleasing appearance to the outboard motor.

Also, it should be readily apparent from viewing FIGS. 1 and 2 that the volume of the chamber formed by the indented area 26 is quite restricted and hence there can be a restriction to air flow. Also this small volume gives rise to relatively short flow paths that makes the water separation more difficult.

Thus, it is believed that the description of FIGS. 1–3 emphasizes the disadvantages of the prior art type of construction, as aforementioned and thus makes the objects of the invention as have already been described more desirable.

SUMMARY OF THE INVENTION

The various features of the invention are adapted to be embodied in a protective cowling arrangement for the power head of an outboard motor and an air inlet arrangement therefor. The cowling arrangement is comprised of a cowling portion that defines an internal area in which the engine of the outboard motor is contained. An air inlet opening is formed in an area of the cowling portion for drawing atmospheric air into an air chamber formed in an exterior area of the cowling arrangement. An air delivery port extends in the cowling arrangement for communicating the air chamber with the internal area for delivering atmospheric air to the engine.

In accordance with a first feature of the invention, a water drain port is formed in the cowling arrangement for draining of water separated from the inducted air in the air chamber back to the atmosphere. This water drain port is spaced from both the air inlet opening and from the air delivery port so as to minimize the likelihood of the separated water being mixed with the air flowing to the engine.

In accordance with another feature of the invention, the air chamber is formed in part by a pair of expansion chambers formed on opposite sides of the cowling assembly and each of which is provided with a respective air delivery port at a forward end thereof for increasing the air flow area available to the interior of the cowling assembly and for placing the point of air admission away from components of the associated engine that should be protected.

DETAILED DESCRIPTION OF THE PREFERRED EMBODIMENT OF THE INVENTION

Figure 4:
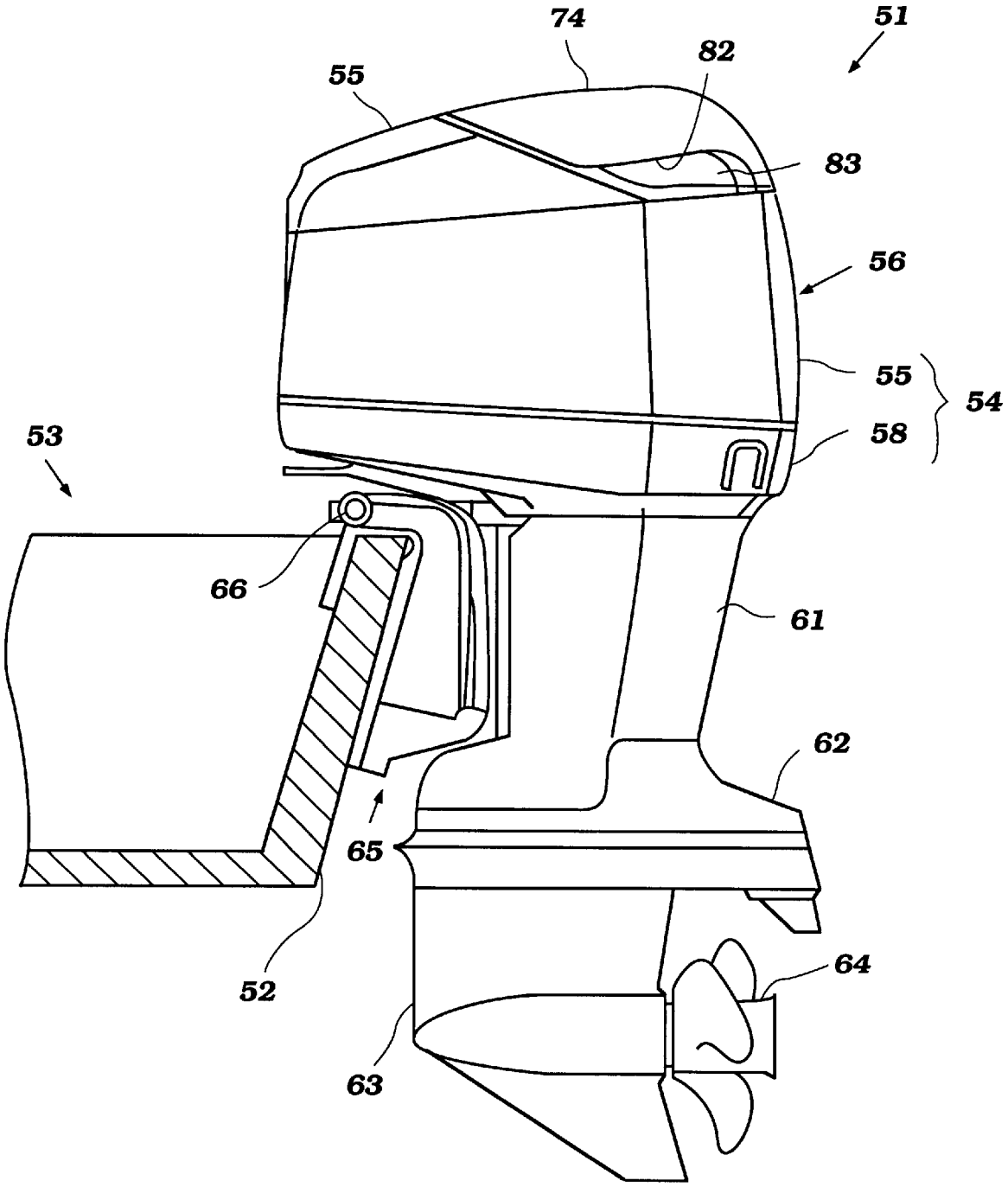
FIG. 4 is a side elevational view of an outboard motor having a protective cowling constructed in accordance with an embodiment of the invention and shown attached to the transom of an associated watercraft, which is shown partially and in cross section.

Referring now in detail to the drawings of the preferred embodiment comprised of FIGS. 4–11, and initially primarily to FIG. 4, an outboard motor constructed in accordance with such a preferred embodiment is indicated generally by the reference numeral 51. The outboard motor 51 is shown in FIG. 4 as attached to a transom 52 of an associated watercraft which is shown partially in cross section and is indicated generally by the reference numeral 53.

The outboard motor 51 except for its protective cowling arrangement, indicated generally by the reference numeral 54 and primarily the main cowling assembly 55 thereof, is mainly conventional in construction. However, the total construction of the outboard motor 51 will be described generally so that those skilled in the art will understand the environment in which the invention is utilized. For the reasons just noted, where any component of the outboard motor 51 is not illustrated or described in detail, those skilled in the art will readily understand how the invention can be practiced with any desired type of construction for the basic outboard motor.

Figure 1:
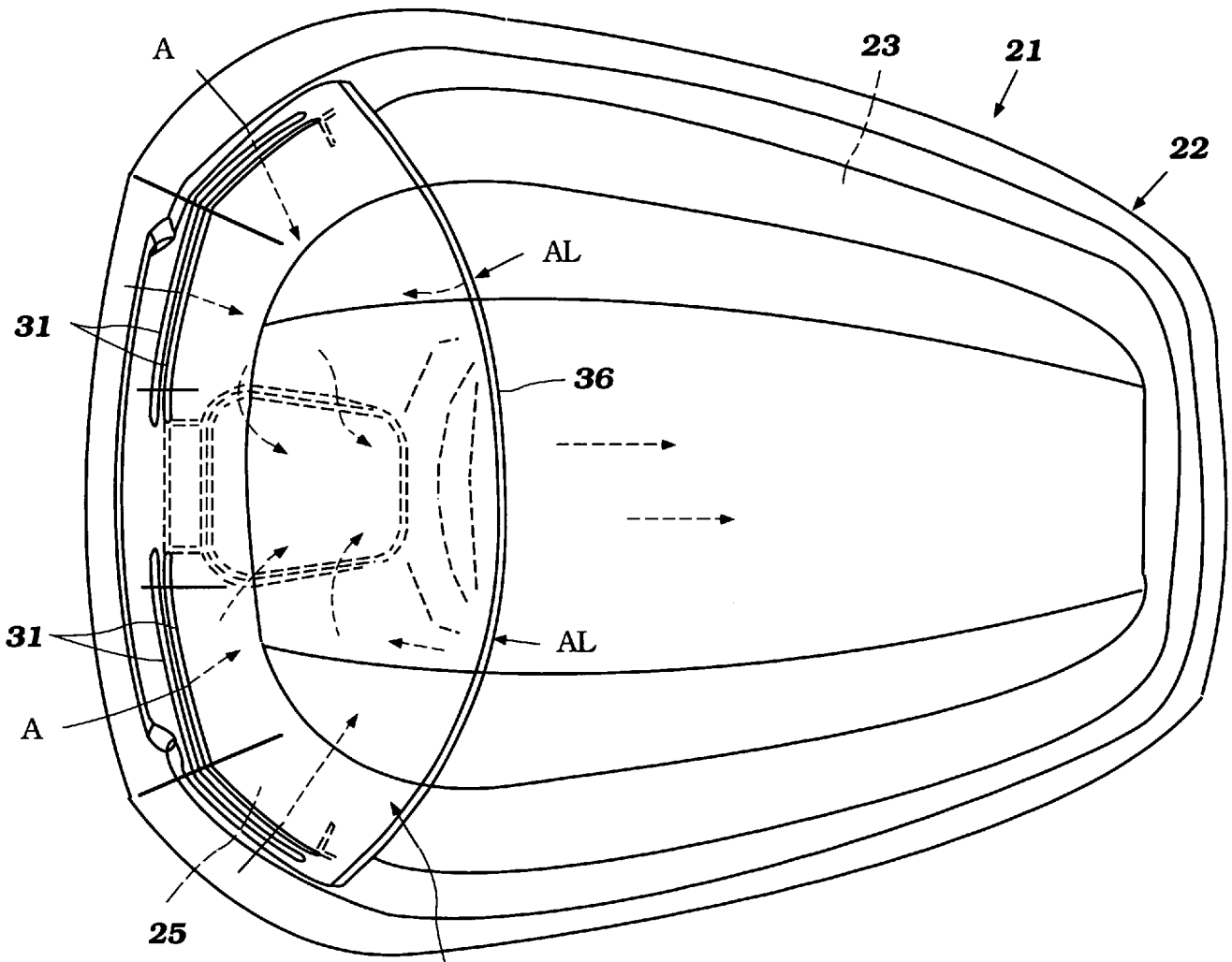
Figure 1 Prior Art
FIG. 1 is a top plan view of the main cowling member of protective cowling of a prior art type of construction utilized to illustrate the disadvantages of the prior art construction.
Figure 2:
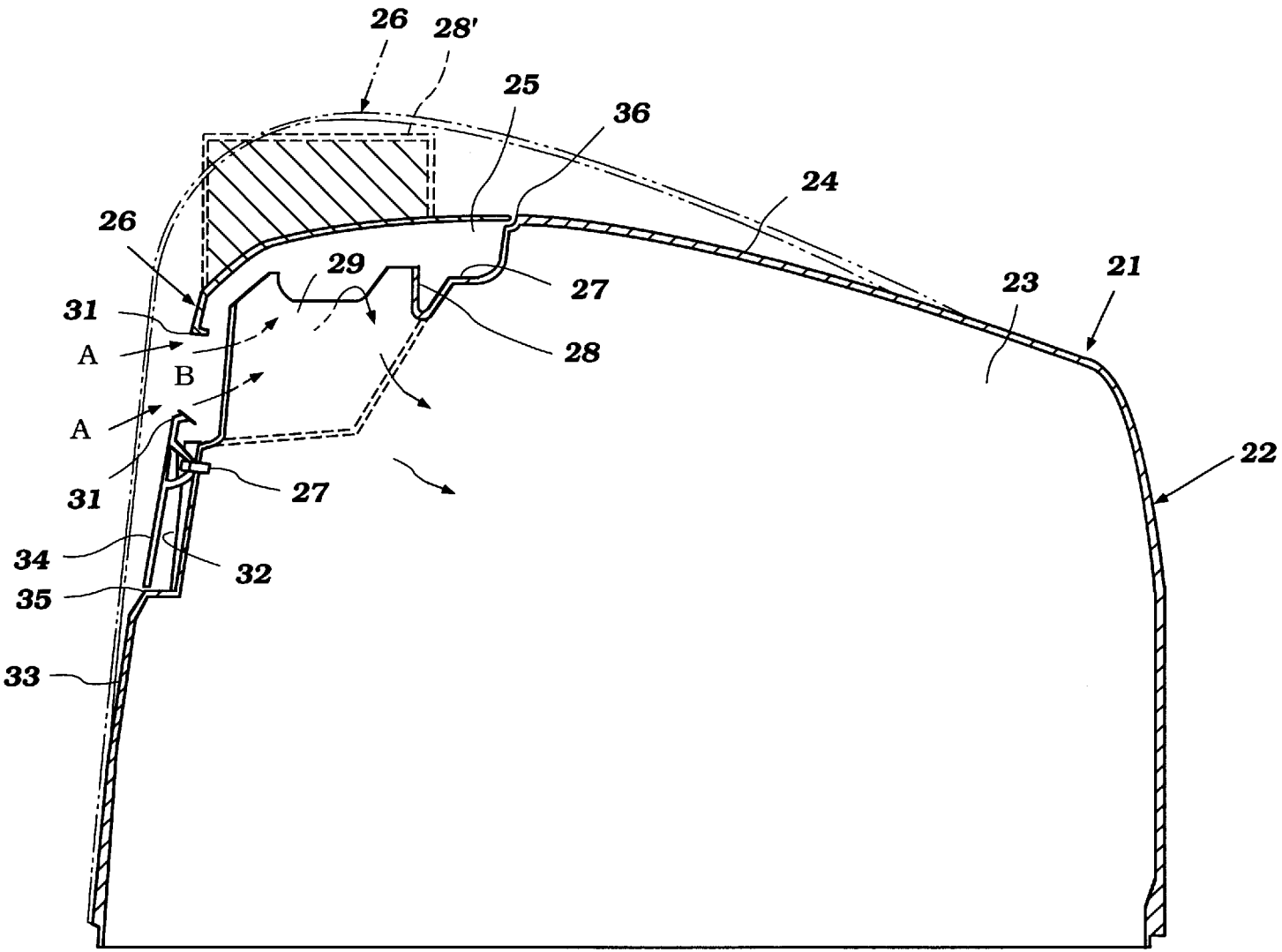
Figure 2 Prior Art
FIG. 2 is a transverse cross-sectional view taken through the cowling component shown in FIG. 1 and shows, in phantom, one possible prior art type of solution to certain problems of the prior art.
Figure 3:
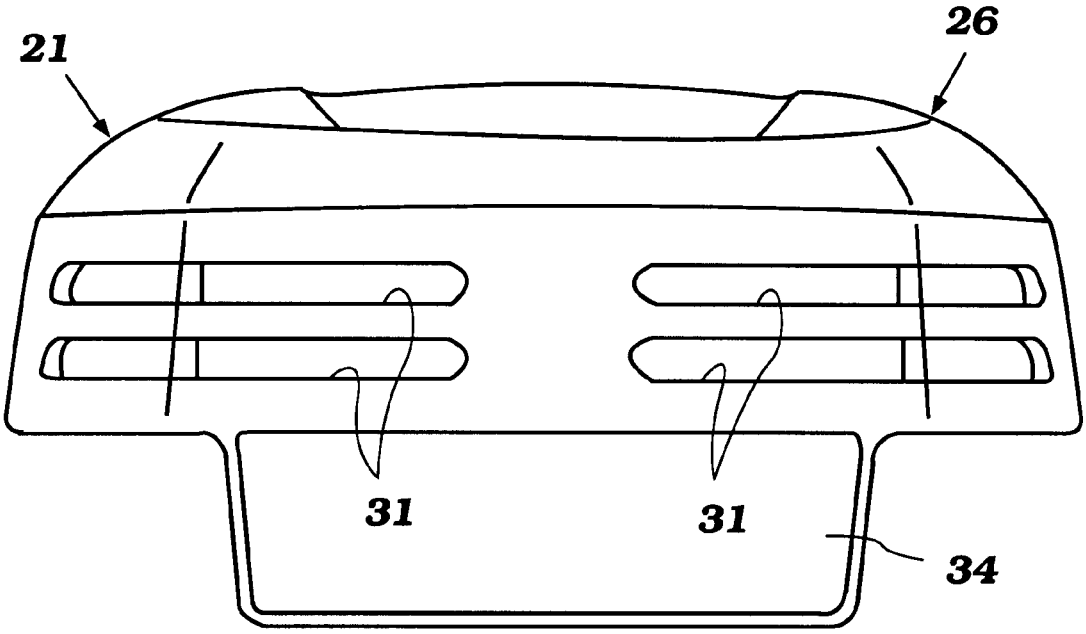
Figure 3 Prior Art
FIG. 3 is a rear elevational view of the closure member of this prior art type protective cowling.
Figure 8:
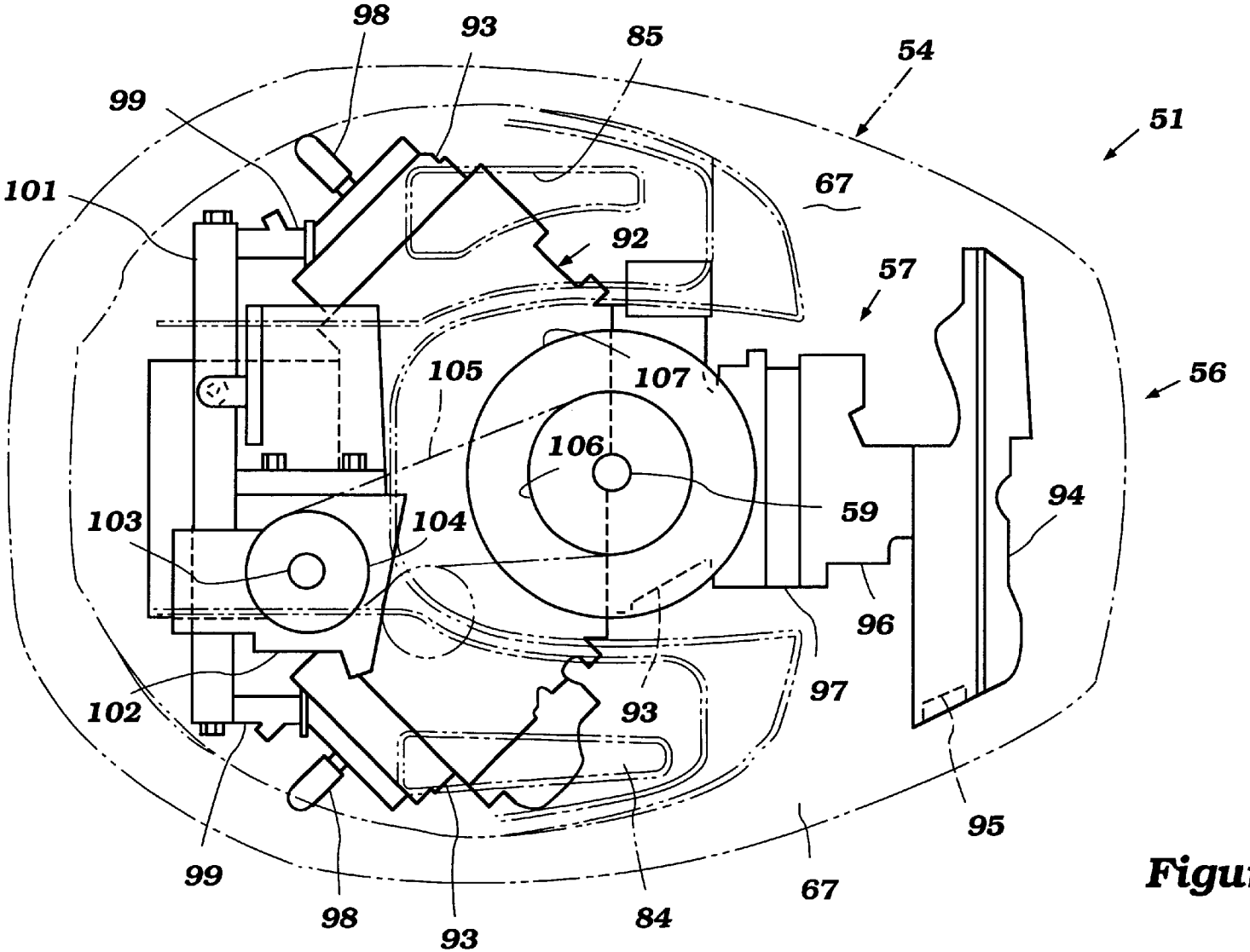
FIG. 8 is a top plan view looking in the same direction as FIG. 5 but shows the cowling member of FIG. 5 in phantom so as to indicate the relationship of its components to the associated engine of the outboard motor.
Figure 9:
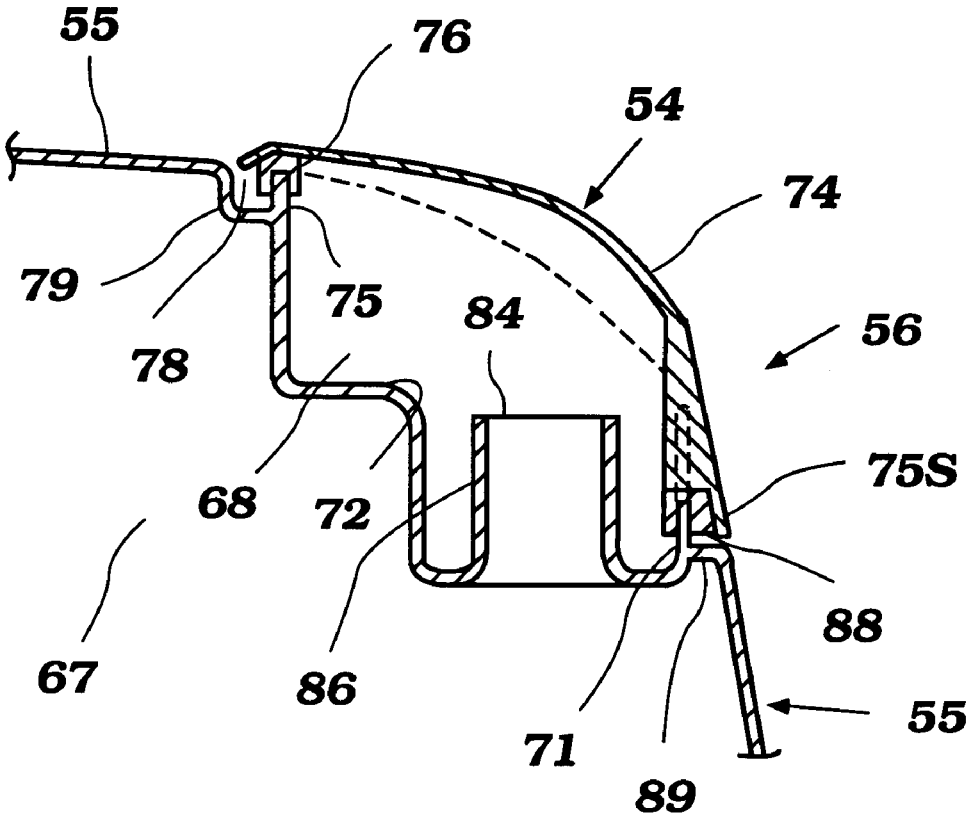
FIG. 9 is a cross-sectional view taken along the line 9—9 of FIG. 5.

The outboard motor 51 is comprised of a power head assembly, indicated generally by the reference numeral 56 and which is comprised of a powering internal combustion engine. This engine does not appear in FIG. 1 but is illustrated in FIG. 8 where it is identified generally by the reference numeral 57. The general configuration of the engine 57 will be described later because its relationship to certain portions of the protective cowling assembly 54 is significant in conjunction with the invention.

In addition to the main cowling assembly 55, the outer cowling 54 includes a tray 58 to which the main cowling assembly 55 is detachably affixed by means of fasteners of a suitable type.

As is conventional in outboard motor practice, the engine 57 is mounted within the protective cowling 54 so that its crankshaft, shown in several of the subsequent figures and identified generally by the reference numeral 59, will rotate about a vertically extending axis. This orientation of the engine 57 is chosen so as to facilitate coupling of its crankshaft 59 to a drive shaft that depends into and is journaled within a drive shaft housing 61.

A lower part 62 of this drive shaft housing is connected to the upper portion of a lower unit 63. This drive shaft continues on into the lower unit 63 where it drives a propeller 64 through a suitable forward, neutral, reverse, transmission. This transmission is not illustrated for the aforenoted reasons.

A combined clamping bracket/swivel bracket assembly, indicated generally by the reference numeral 65, is connected to the drive shaft housing 61 and the watercraft transom 52 for steering of the outboard motor 51 about a vertically extending axis and for tilt and trim movement of the outboard motor 51 about a horizontally-disposed axis. This latter axis is defined by a tilt pin 66. Movement about the tilt pin 66 permits trim adjustment of the propeller 64 and also permits the outboard motor 51 to be pivoted up to an out of the water position for trailering, servicing, or other purposes.

Referring now in primary detail to the remaining figures of this embodiment (FIGS. 5–11), the construction of the main cowling member 55 will be described in detail. As has been previously noted, this main cowling member 55 encloses the engine 57 and thus defines an internal cavity 67 which generally encircles the engine 57 in a relationship as seen best in FIG. 8.

The main cowling member 55 has a generally inverted cup shape with a recess or depression 60 that extends on opposite sides from approximately the rearward third thereof to a common portion that extends transversely across the rear end of the cowling assembly 56 so as to define a generally horseshoe shaped recess. The expansion chamber defined in part by this recess 60 is indicated generally by the reference numeral 68 and comprises, as will become apparent later, a pair of expansion chambers.

Figure 10:
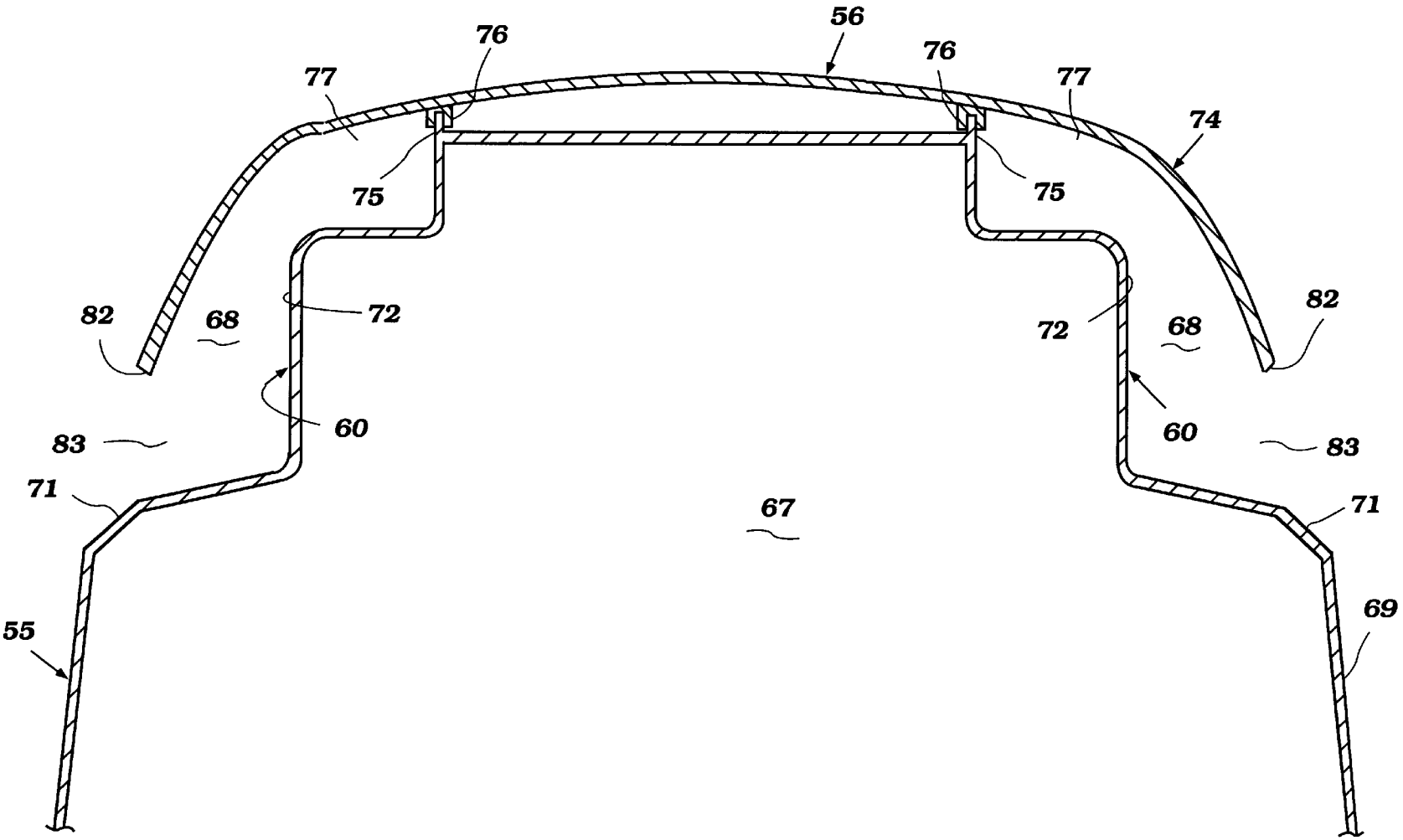
FIG. 10 is an enlarged cross-sectional view taken along the line 10—10 of FIG. 5.
Figure 11:
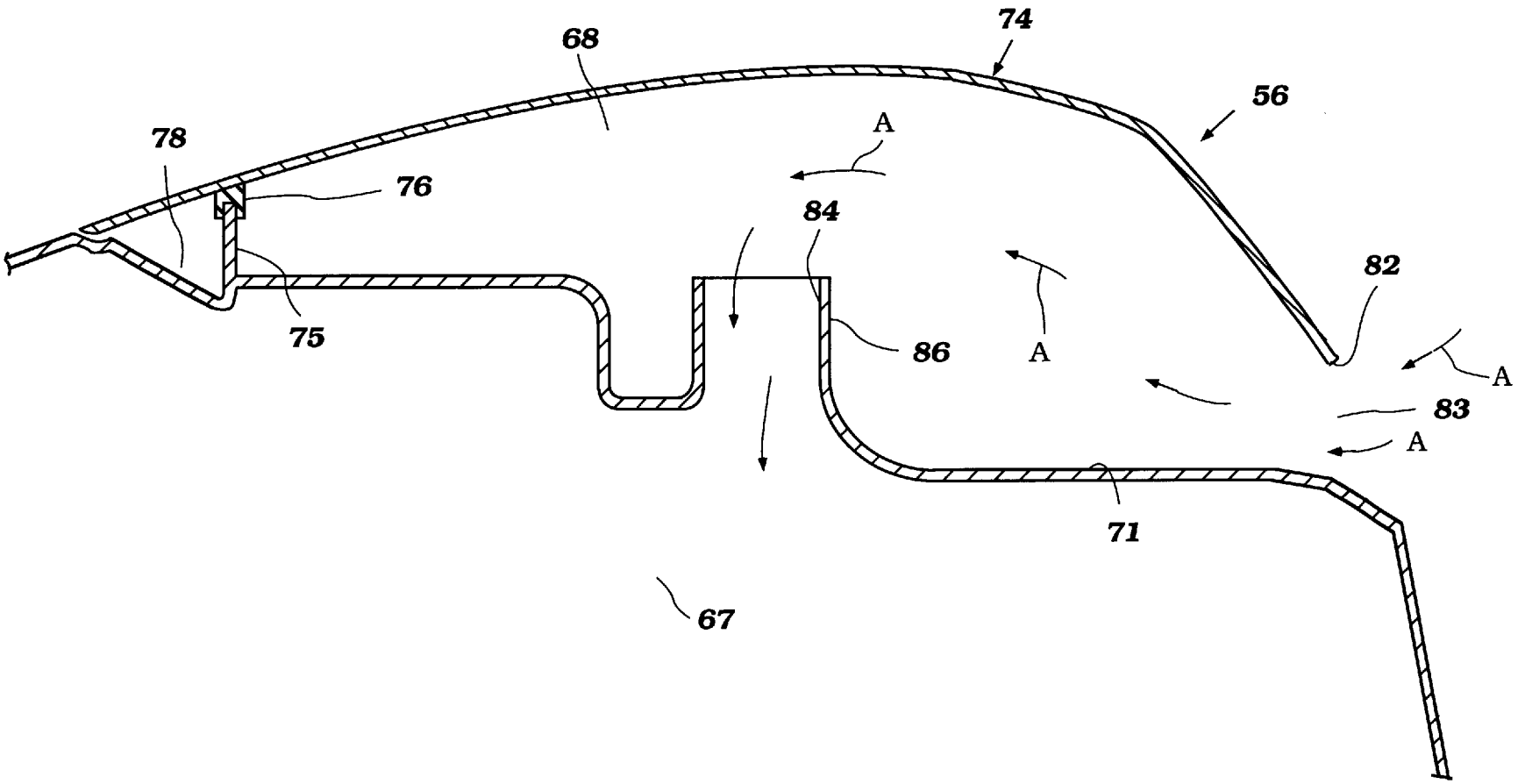
FIG. 11 is an enlarged cross-sectional view taken generally along the line 11—11 of FIG. 5 but showing primarily the construction at the rear end thereof.

As best seen in FIG. 10, the side portion 69 of the main cowling member 55 extends upwardly and then has an inwardly extending portion 71 that terminates in a pair of upstanding walls 72 that define generally the inner terminus of the expansion chamber 68. This air inlet cavity 68 is further defined by a closure piece, indicated generally by the reference numeral 74, which also has a generally horseshoe shape and which may be formed from a material that is similar to or the same as that from which the main cowling member 55 is formed.

The peripheral edge of this air inlet cavity and expansion chamber 68 is defined by an upstanding ridge 75 that receives a sealing gasket 76 which is compressed between the closure piece 74 and this ridge 75 so as to provide water-tight seal. The upper end of the wall 72 curves inwardly to define a pair of further cavity portions 77 immediately outwardly of the seal or gasket 76 and at the upper portion of the expansion chamber 68. This provides an increased volume and also provides clearance over the center portion of the engine 57 for reasons which will be described later.

At the inner sides of the forwardly extending side legs of the horseshoe shape formed by the cover piece 74, and in the main cowling member 55, there is formed a generally U-shaped gutter 78 which is defined in primary part by an upstanding wall 79 which is spaced from the ridge 75. The ridge 75 has a central portion 75*c* that follows the shape of the middle portion of the cover piece 74 and which terminates in a pair of front edges 75*e*. The ridge 75 then extends rearwardly at each side to form side pieces 75*s*. This defines the inner extremity of the gutter 78.

Figure 6:
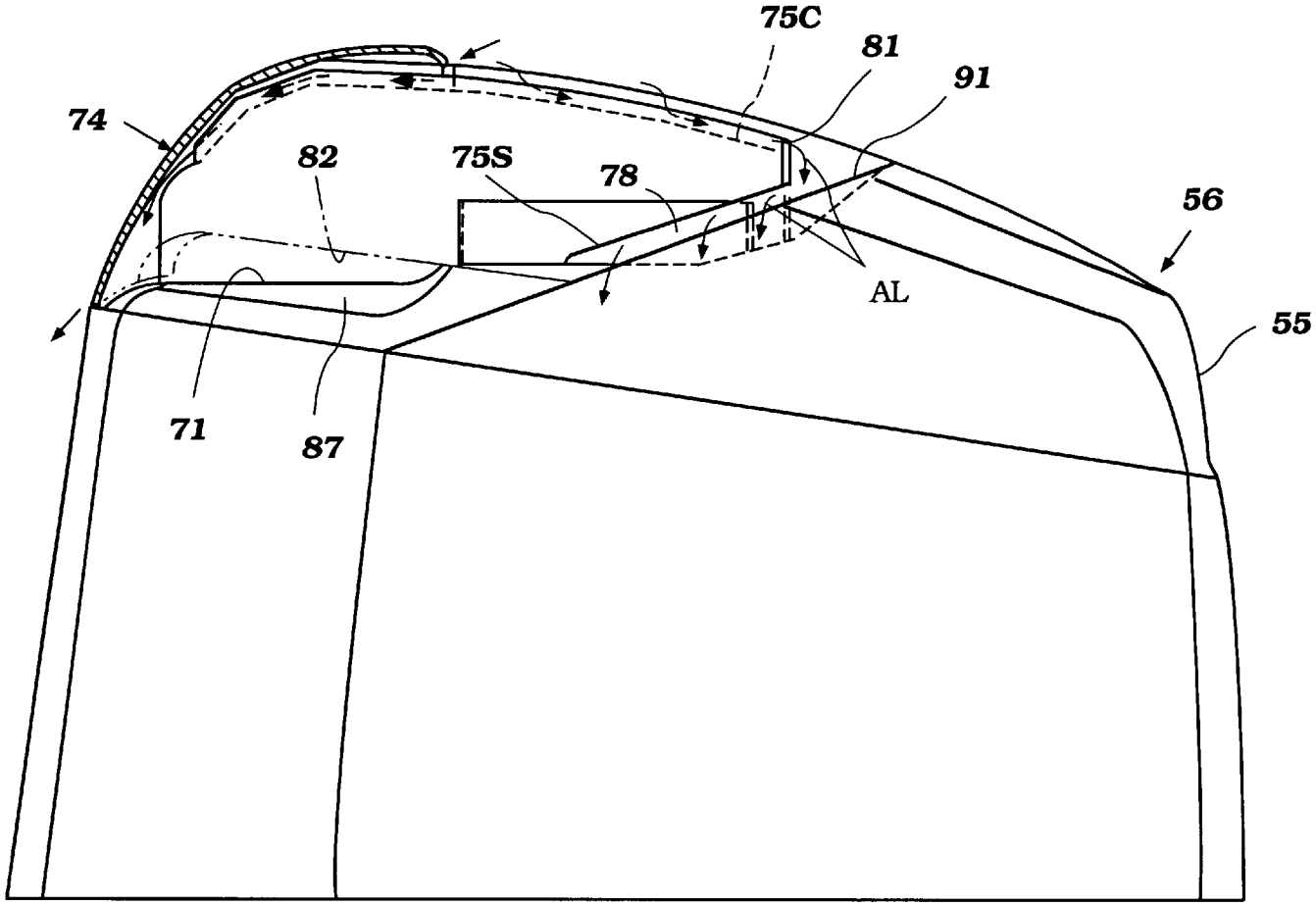
FIG. 6 is a side elevational view, with portions broken away and which is in part similar to FIG. 2, showing the construction of the preferred embodiment of the invention.
Figure 7:
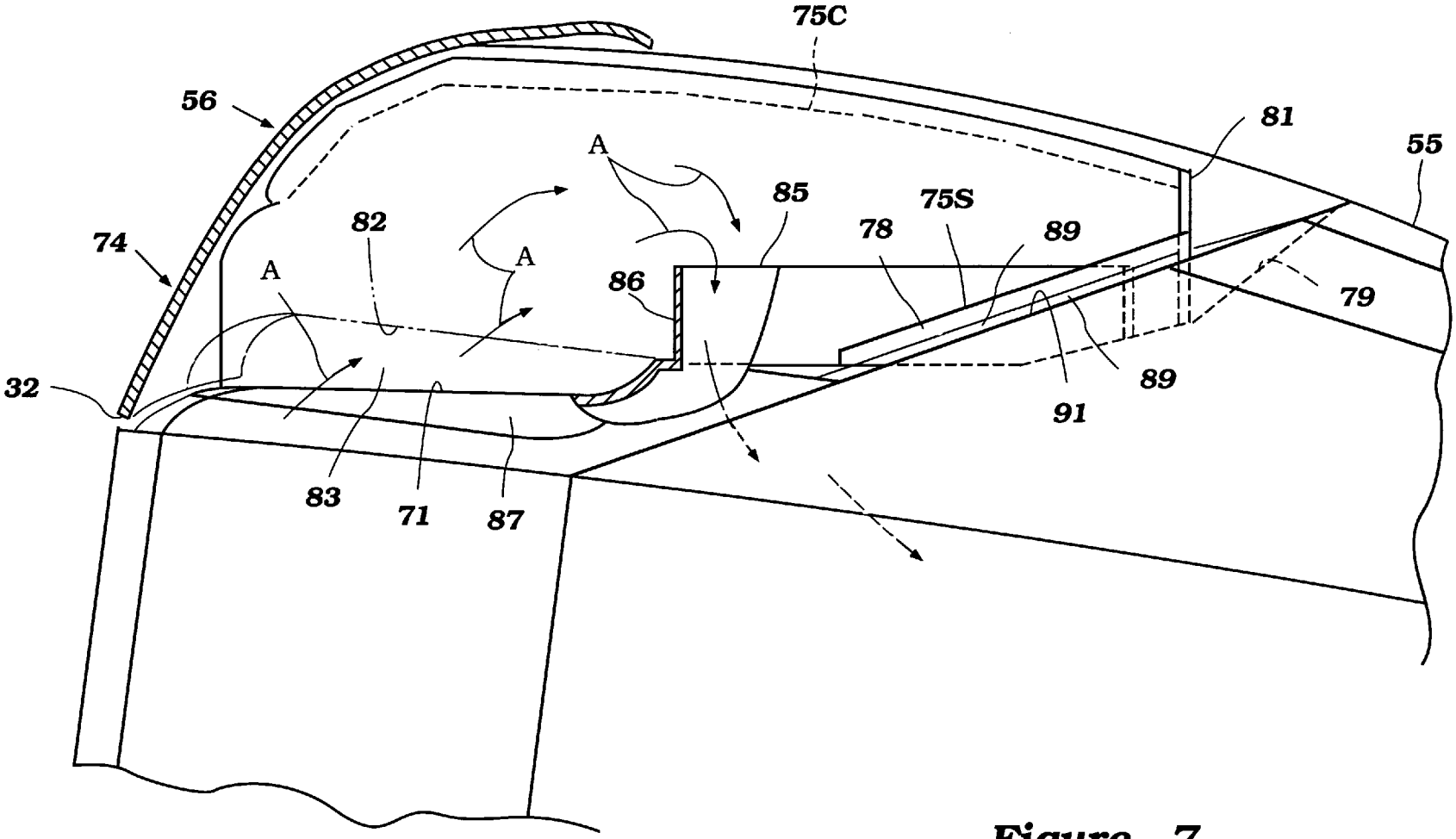
FIG. 7 is an enlarged view of the broken away portion shown in FIG. 6 with further portions broken away so as to show the configuration of the air inlet arrangement and the water drain associated therewith.

This gutter 78 extends longitudinally along the sides of the cover assembly and downwardly in drain portions 81 around the sides of the gutter 78 as best seen in FIG. 6 at the peripheral edges thereof. As will become apparent as this description precedes, any water that may be swept into this area and collect by the motion of the watercraft through the body of water will be trapped in this gutter 78 and drained away from the air inlet arrangement that permits the air to flow into the interior 67 of the cowling assembly 56.

Figure 5:
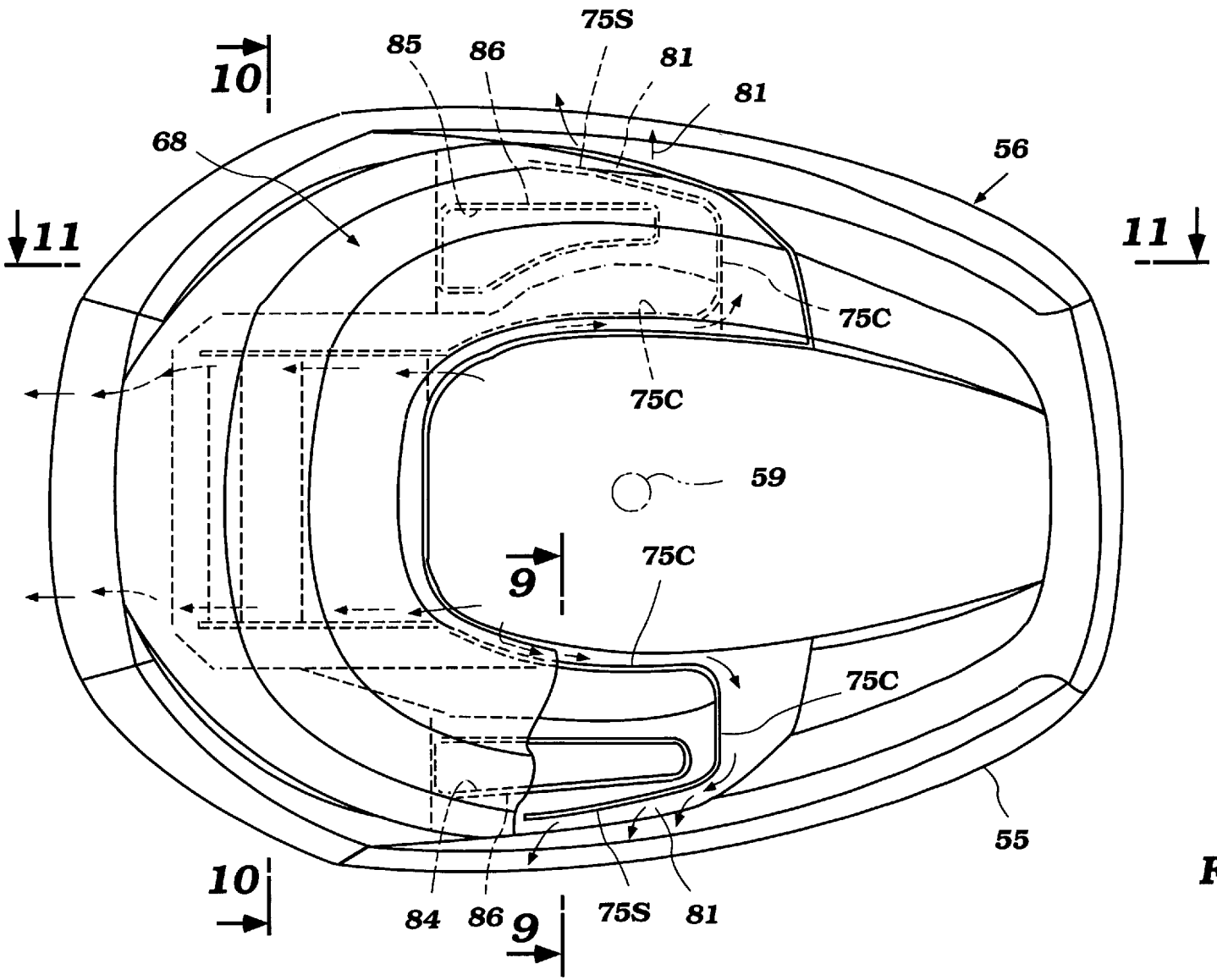
FIG. 5 is a top plan view, in part similar to FIG. 1 but shows the protective cowling in accordance with an embodiment of the invention.

As best seen in FIGS. 4, 6, 7 and 10, the rearward portion of the closure piece 74 is formed with a lower edge portion 82 that extends along the rearward portion of the sides and slightly around the back of the cover member 56. This defines a pair of inlet openings 83 that are formed at the side and rear ends of the cover assembly. Thus, atmospheric air can flow into the portions of the expansion chamber 68 at each side as indicated by the arrows A in the various figures. This incoming air flows forwardly through the expansion chamber volumes 68 to a pair of longitudinally extending inlet openings 84 and 85, each of which has a slightly different shape as seen in FIGS. 5 and 8 and which are formed by raised tuning necks 86 at each side thereof. As may be seen the ridge portions 75*s* lie outwardly of these tuning necks 86 to keep the drained water away from them.

These inlet openings 84 and 85 have a relatively long axial extent and some significant transverse width so that the air can flow freely into them from these expansion chambers 68. Thus, there is not only a long air flow path provided by this construction, but also the air will be turned as seen best in FIG. 11 so as to assist in water separation.

It should be see that the main cover member 55 has a pair of outwardly flared surfaces formed in part by the recesses 71 but which taper downwardly through flares, indicated by the reference numerals 87, adjacent the air inlet openings 83 but spaced well away from the inlet openings 84 and 85 to the interior of the cowling.

Also, it should be noted that the vertically extending edges 75*s* of the front and transverse gutter 78 meet with a further water drain opening 88 that is formed by a cut-out 89 in each side of the cover member 74 and which cooperates with a downwardly sloping forward surface 91 of the main cowling member 55 so that the main water separation drain will be well spaced from the air inlet openings 83.

The air flow within the inlet expansion chamber 68 will pass generally forwardly and hence, the water particles will impinge upon the surfaces 91 and drain back out primarily of the openings 88. Therefore, this construction is very effective in ensuring water separation and water draining in an area well away from the area where the air is inducted.

Referring now to FIG. 8, this shows also the configuration of the cowling and specifically the inlet openings 84 and 85 and how they are located so that they will not be in proximity to certain components of the engine 57. In FIG. 8, the engine 57 is depicted as being of the high performance, two cycle crankcase compression type having a V configuration defined by a cylinder block 92 that has a pair of cylinder banks, each of which is provided with a respective cylinder head 93. The cylinder banks and cylinder heads form the combustion chambers of the engine, as is well known.

The crankshaft 59, which is driven by pistons reciprocating in the cylinder bores of the cylinder block 92 rotate in a crankcase chamber defined in part by a crankcase member 93. An air induction system including an air inlet device 94 having inlet openings 95 draws air from within the protective cowling interior chamber 67. This air is then delivered to throttle bodies 96 and to manifold intake ports through reed type check valves 97 in a manner well known in this art.

In accordance with an important feature of the invention, the engine 57 is provided with direct cylinder injection. Therefore, in addition to mounting spark plugs 98 in the cylinder heads 93, fuel injectors 99 are mounted therein and spray directly into the combustion chambers of the engine. The internal construction of the engine and the injection system is not shown because the important feature is the location of the inlet openings 84 and 85 relative to the exterior components of the engine and specifically those associated with the injection system.

The fuel injectors 99 receive fuel through a main fuel manifold or main fuel rail 101 which extends transversely across the engine. Fuel is delivered to this fuel rail 101 by a high pressure pump 102 having pumping plungers that are driven by a pump drive shaft 103. A pulley 104 is fixed to the pump drive shaft 103 and is driven by a belt 105 from a corresponding drive pulley 106 fixed to the crankshaft 59. A flywheel 107 is mounted above or below this drive pulley 106 in a suitable manner.

Thus, by moving the air inlet opening into the interior of the cowling from a rear central portion as with the prior art devices to a pair of side forward portions, the inlet openings 84 and 85 are moved well clear of not only the spark plugs 98, but also the fuel injectors 99, fuel rail 101 and high pressure fuel pump 102. Thus, in addition to the enhanced water separation provided by this arrangement, any water that may be entrained in the intake area be directed to these components of the engine.

Thus, from the foregoing description, it should be readily apparent that the described embodiment of the invention provides a very effective protective cowling for an outboard motor and particularly one employing direct cylinder fuel injection. Of course, the foregoing description is that of the preferred embodiment of the invention. Various changes and modifications may be made without departing from the spirit and scope of the invention, as defined by the appended claims.

What is claimed is:

1. A protective cowling for the power head of an outboard motor and an air inlet arrangement therefore, said cowling arrangement being comprised of a cowling portion that defines an internal area in which the engine of the outboard motor is contained, a pair of air inlet openings, each formed on an opposite side of said cowling portion for drawing atmospheric air into an air chamber formed in an exterior area of said cowling arrangement, an air delivery port extending in said cowling arrangement for communicating said air chamber with said internal area for delivering atmospheric air to the engine, and a water drain port formed in said cowling arrangement for draining of water separated from the inducted air in said air chamber back to the atmosphere, said water drain port being spaced in a longitudinal direction from both said air inlet opening and said air delivery port so as to minimize the likelihood of the separated water being mixed with the air flowing to the engine.

2. A protective cowling for the power head of an outboard motor and an air inlet arrangement therefore, said cowling arrangement being comprised of a cowling portion that defines an internal area in which the engine of the outboard motor is contained, an air inlet opening formed in an area of said cowling portion for drawing atmospheric air into an air chamber formed in an exterior area of said cowling arrangement, an air delivery port extending in said cowling arrangement for communicating said air chamber with said internal area for delivering atmospheric air to the engine, and a water drain port formed in said cowling arrangement for draining of water separated from the inducted air in said air chamber back to the atmosphere, said water drain port being spaced from both said air inlet opening and said air delivery port so as to minimize the likelihood of the separated water being mixed with the air flowing to the engine and formed in said cowling arrangement forwardly of said air inlet opening.

3. A protective cowling as set forth in claim 2 wherein the air inlet opening is formed at least in part in a rearward surface of the cowling arrangement and the water drain port is formed in a side surface of the cowling arrangement.

4. A protective cowling as set forth in claim 3 wherein there are a pair of air inlet openings formed at the rear sides of the cowling arrangement and a pair of water drain ports formed at forward portions of the sides of the cowling arrangement.

5. A protective cowling as set forth in claim 4 wherein a gutter arrangement is formed outwardly of the pair of air inlet openings for directing water away from said air inlet openings toward the pair of water drain ports.

6. A protective cowling arrangement for the power head of an outboard motor and an air inlet arrangement therefore, said cowling arrangement being comprised of a cowling portion that defines an internal area in which the engine of the outboard motor is contained, an air inlet opening formed in an area of said cowling portion for drawing atmospheric air into an air chamber formed in an exterior area of said cowling arrangement and formed by a main cowling member having a recessed area formed at the rearward portion thereof and covered by a closure member fixed to the main cowling portion and defining with the main cowling member said air inlet opening, an air delivery port extending in said cowling arrangement for communicating said air chamber with said internal area for delivering atmospheric air to the engine, and a water drain port formed in said cowling arrangement for draining of water separated from the inducted air in said air chamber back to the atmosphere, said water drain port being spaced from both said air inlet opening and said air delivery port so as to minimize the likelihood of the separated water being mixed with the air flowing to the engine.

7. A protective cowling as set forth in claim 6 wherein the closure member and the main cowling member have mating peripheral edges extending along the forward portion of the closure member and wherein the main cowling member defines a gutter contiguous to said mating edges in which water can accumulate and which gutter is communicated with the water drain port.

8. A protective cowling as set forth in claim 7 wherein there are a pair of air inlet openings formed at the rear sides of the cowling arrangement and a pair of water drain ports formed at forward portions of the sides of the cowling arrangement and the gutter directs water to both of said water drain ports.

9. A protective cowling as set forth in claim 8 wherein the main cowling member has an upstanding wall that defines the inner peripheral extent of the gutter.

10. A protective cowling as set forth in claim 9 wherein a seal is formed between the forward portion of the closure member and the upstanding wall.

11. A protective cowling for the power head of an outboard motor and an air inlet arrangement therefore, said cowling arrangement being comprised of a cowling portion that defines an internal area, in which the engine of the outboard motor is contained, and air delivery port extending in said cowling arrangement for communicating said air chamber with said internal area for delivering atmospheric air to the engine, said air chamber being formed in part by a pair of expansion chambers formed on opposite sides of said cowling arrangement and each of which is provided with a respective air delivery port at a forward end thereof for increasing the air flow area available to the interior of the cowling assembly and for placing the point of air admission away from components of the associated engine that should be protected and a pair of air inlet openings, one for each expansion chamber, formed in an area of said cowling portion for drawing atmospheric air into said expansion chambers.

12. A protective cowling as set forth in claim 11 wherein the engine is provided with a direct cylinder fuel injection system and the components thereof are spaced from the air flow through the air delivery ports.

13. A protective cowling as set forth in claim 12 wherein the engine is of the v type with the cylinder banks juxtaposed to the air delivery ports.

14. A protective cowling as set forth in claim 13 wherein there are a pair of water drain ports formed in the cowling arrangement for draining of water separated from the inducted air in the air chamber back to the atmosphere, said water drain ports being spaced from both said air inlet openings and said air delivery ports so as to minimize the likelihood of the separated water being mixed with the air flowing to the engine.

15. A protective cowling arrangement as set forth in claim 14 wherein the cowling arrangement is formed by a main cowling member having a recessed area formed at the rearward portion thereof and covered by a closure member fixed to the main cowling portion and defining with the main cowling member the air inlet opening and the expansion chambers.

16. A protective cowling as set forth in claim 15 wherein the closure member and the main cowling member have mating peripheral edges extending along the forward portion of the closure member and wherein the main cowling member defines a gutter contiguous to said mating edges in which water can accumulate and which gutter is communicated with the water drain port.

17. A protective cowling as set forth in claim 16 wherein the gutter directs water to both of said water drain ports.

18. A protective cowling as set forth in claim 17 wherein the main cowling member has an upstanding wall that defines the inner peripheral extent of the gutter.

19. A protective cowling as set forth in claim 18 wherein a seal is formed between the forward portion of the closure member and the upstanding wall.

* * * * *